US006859130B2

(12) United States Patent
Nakashima et al.

(10) Patent No.: US 6,859,130 B2
(45) Date of Patent: Feb. 22, 2005

(54) LOW-PROFILE TRANSFORMER AND METHOD OF MANUFACTURING THE TRANSFORMER

(75) Inventors: Koji Nakashima, Matsusaka (JP); Satoru Taniguchi, Matsusaka (JP); Naoki Hashimoto, Matsusaka (JP); Tomio Marui, Matsusaka (JP); Tsukasa Suzuki, Taki-gun (JP); Fumiaki Hashimoto, Matsusaka (JP); Satoru Inaba, Matsusaka (JP)

(73) Assignee: Matsushita Electric Industrial Co., Ltd. (JP)

( * ) Notice: Subject to any disclaimer, the term of this patent is extended or adjusted under 35 U.S.C. 154(b) by 40 days.

(21) Appl. No.: 10/466,956

(22) PCT Filed: Oct. 24, 2002

(86) PCT No.: PCT/JP02/11061

§ 371 (c)(1),
(2), (4) Date: Jul. 23, 2003

(87) PCT Pub. No.: WO03/036665

PCT Pub. Date: May 1, 2003

(65) Prior Publication Data

US 2004/0070480 A1 Apr. 15, 2004

(30) Foreign Application Priority Data

Oct. 24, 2001 (JP) ..... 2001-326245

(51) Int. Cl.[7] ..... H01F 5/00

(52) U.S. Cl. ..... 336/200; 336/232; 336/223; 336/83; 29/602.1

(58) Field of Search ..... 336/200, 83, 223, 336/232; 29/602.1, 605, 606

(56) References Cited

U.S. PATENT DOCUMENTS 5,900,797 A * 5/1999 Dougauchi ..... 336/200
5,949,321 A * 9/1999 Grandmont et al. ..... 336/232
6,000,128 A * 12/1999 Umeno et al. ..... 29/846
6,181,232 B1 * 1/2001 Kitamura ..... 336/200
6,618,929 B2 * 9/2003 Kitamura ..... 29/602.1
6,710,694 B2 * 3/2004 Matsuta et al. ..... 336/200
6,774,757 B2 * 8/2004 Fujiyoshi et al. ..... 336/200
2001/0052838 A1 * 12/2001 Hamanaka et al. ..... 336/200

FOREIGN PATENT DOCUMENTS

| | | | |
|---|---|---|---|
| JP | 04145610 A * | 5/1992 | ..... H01F/41/04 |
| JP | 5-13027 | 2/1993 | |
| JP | 5-31213 | 4/1993 | |
| JP | 7-22252 | 1/1995 | |
| JP | 7-374386 | 2/1995 | |
| JP | 7-240324 | 9/1995 | |
| JP | 7-326525 | 12/1995 | |
| JP | 8-148348 | 6/1996 | |
| JP | 9-219324 | 8/1997 | |
| JP | 10-163039 | 6/1998 | |
| JP | 10-340819 | 12/1998 | |
| JP | 11-97259 | 4/1999 | |
| JP | 11144965 A * | 5/1999 | ..... H01F/17/00 |
| JP | 2000-308750 | 11/2000 | |
| JP | 2001-284130 | 10/2001 | |

* cited by examiner

*Primary Examiner*—Anh Mai
(74) *Attorney, Agent, or Firm*—Parkhurst & Wendel, L.L.P.

(57) ABSTRACT

A multilayered coil is formed by inserting insulating paper 13 having either a pressure sensitive adhesive or an adhesive disposed on both faces thereof into at least one place between thin coil layers and then magnetic cores 15 are mounted to the multilayered coil from above and below. Thus, a thin transformer for a switching power supply is provided, in which variation in distance between coil 11 and coil 12, of which one is disposed over the other, variation in distance of coil 11 and coil 12 from magnetic core 15 and the like are suppressed.

25 Claims, 8 Drawing Sheets

LOW-PROFILE TRANSFORMER AND METHOD OF MANUFACTURING THE TRANSFORMER

TECHNICAL FIELD

The present invention relates to a thin transformer for a switching power supply mounted on a thin power unit for use in electronic apparatuses, particularly for use in communication apparatuses, and a method of manufacturing the same.

BACKGROUND ART

In recent years, with the rapid advancement in the infrastructural network of information and communication, increase in power consumption has become a social issue. Power supply system for communication apparatuses, in particular, is shifting from centralized supply to decentralized supply in order to meet demands for reduction in size of the equipment and power consumption therein. Today, for such power units, small and thin onboard power supplies are being widely used. On the other hand, to meet the demands for large current required for speedup of LSI and for reduction of power consumption, a low-voltage setup is being rapidly advanced. Measures that meet demands for lower voltage and larger current a required of onboard power units for driving such LSIs. There is a technological tendency toward increasing the switching frequency as a measure to achieve a further reduction in size of the thin onboard power unit. Especially for the transformer as the major component of the power supply unit, there is a demand for a thin transformer of a surface-mount type that is suited for high-frequency driving, has low-loss and low-noise characteristics, small in size, and low in price.

To meet the need for development of such power units, a laminated-coil thin transformer is disclosed in Japanese Patent Laid-open Application No. H10-340819. A coil base is used therein for positioning coils that are piled up. Also, there is an attempt not to use a positioning coil base for increasing the space factor of the coil, thereby enhancing the electrical characteristic of the transformer. FIG. 10 is an exploded perspective view of a conventional multilayered thin transformer having no coil base for positioning of coils to be piled up. FIG. 11 is a sectional view showing the multilayer structure of the conventional multilayered thin transformer of FIG. 10. Two each of non-wirewound primary coils and secondary coils are produced from a conductor in a thin plate form by such a method as punching or etching. A multilayered coil assembly is fabricated by piling insulating paper 3, secondary coil 2, insulating paper 3, primary coil 1, insulating paper 3, secondary coil 2, insulating paper 3, primary coil 1, and insulating paper 3, one on another, as shown in FIG. 10. Then, a suitable amount of adhesive 8, for bonding magnetic core 5 to the multilayered coil, is applied to the top and bottom faces of the multilayered coil. Finally, magnetic cores 5 are mounted in place from above and below and, thereby, a thin transformer is completed. After the completion of the transformer, each coil is connected with a terminal. Each coil is connected to terminal 6 provided on main-unit base 9 via connection portion 7 by such a method as soldering or welding as shown in FIG. 11. In the conventional example shown in FIG. 10, coils are piled up without using a coil base for positioning the coils.

Therefore, relative positions between coils and insulating paper 3 become unstable. Hence, as shown in FIG. 11, great variations are produced in distance A between a primary coil and a secondary coil and distance B between a coil and a magnetic core.

Further, since the coils are piled up individually, operability in the mounting of the magnetic core is much impaired. As a result, insulation performance and electrical performance are not stabilized and hence great problems in terms of quality and productivity arise.

The present invention aims to solve the above discussed problems in the conventional art examples and to provide a multilayered thin transformer of a coil-baseless type providing stabilized insulating performance and electrical performance and manufactured with high productivity, as well as to provide a method of manufacturing the same.

DISCLOSURE OF INVENTION

The invention provides a thin transformer comprising an insulating paper having either a pressure sensitive adhesive or an adhesive disposed on both faces thereof, a multilayered coil configured by having the insulating paper inserted into at least one place between thin coil layers, and magnetic cores mounted to the multilayered coil from above and below. It further provides a method of manufacturing a thin transformer comprising a first step for preparing thin coils constituting primary coils and secondary coils, a second step for forming a multilayered coil by inserting an insulating paper provided with either a pressure sensitive adhesive or an adhesive disposed on both faces thereof into at least one place between the thin coils, and a final step for mounting magnetic cores to the multilayered coil from above and below.

DETAILED DESCRIPTION OF PREFERRED EMBODIMENTS

The present invention will be described below in concrete terms with reference to the drawings. All the drawings are perspective views and not such that indicate each position of elements accurately.

First Exemplary Embodiment

Figure 1:
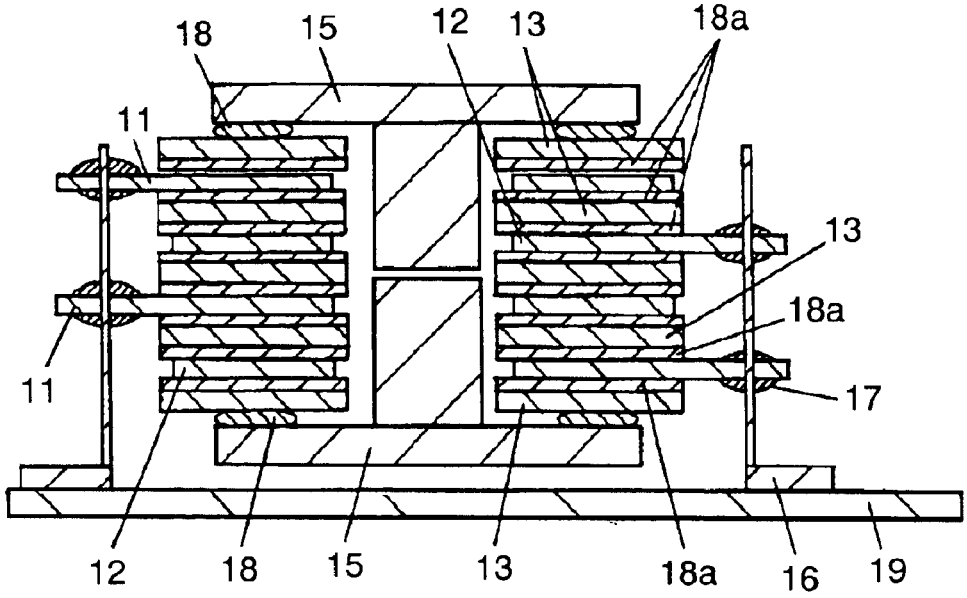
FIG. 1 is a sectional view showing a laminated structure of a thin transformer in a first exemplary embodiment of the present invention.

FIG. 1 is a sectional view showing a laminated structure of a thin transformer of a first exemplary embodiment of the invention. As shown in FIG. 1, a coil of a non-wirewound type is produced from a thin copper sheet by such a method as punching or etching. Two each of such coils are prepared and they are used as primary coil 11 and secondary coil 12. Then, insulating paper 13 provided with pressure sensitive adhesive 18*a* attached to both sides thereof is stamped into a predetermined shape. Insulating paper 13 provided with pressure sensitive adhesive 18*a* may be a commercially-available pressure sensitive adhesive tape.

Otherwise, insulating paper 13 may be applied with either pressure sensitive adhesive 18*a* or adhesive 18 and may thereafter be used. It is preferred that insulating paper 13 be a heat-resistant polyimide film (PI). Other than PI, any of insulating thin film materials may be used for insulating paper 13. Then, as shown in FIG. 1, insulating paper 13 with pressure sensitive adhesive 18*a* attached thereto, secondary coil 12, insulating paper 13 with pressure sensitive adhesive 18*a* attached thereto, and primary coil 11 are piled on one another and thus a multilayered coil is formed. Though it is not shown, a laminating jig is used for controlling relative positions between coils and insulating paper 13 in the laminating process. A suitable amount of adhesive 18 for bonding the laminated coil to magnetic core 15 is applied to the top and bottom faces of the produced multilayered coil. Finally, magnetic cores 15 are mounted in place from above and below and thereby a thin transformer is completed. Each coil is connected with a terminal after the completion of the transformer. As shown in FIG. 1, each coil is connected by such a method as soldering or welding to terminal 16 provided on main-unit base 19 via connection portion 17. According to the first embodiment of the present invention as described above, the multilayered coil is constructed by inserting insulating paper 13, which has either pressure sensitive adhesive 18*a* or adhesive 18 disposed on both sides thereof, at least at one place between thin coil layers. Since cores 15 are mounted to the multilayered coil from above and below, occurrence of mutual displacement between the coil and insulating paper 13 can be semipermanently prevented both during the fabrication of the transformer and after its completion. More particularly, variation in the distance between coils piled on one another and the distance between the coil and magnetic core can be suppressed.

Further, since individual coils constituting the multilayered coil are bonded together and integrated by pressure sensitive adhesive 18*a* or adhesive 18 applied to both sides of the insulating paper, the operability when the magnetic core is mounted can be greatly enhanced.

The fabrication method of the first embodiment of the present invention comprises a first step of preparing thin coils constituting the primary coil and the secondary coil, a second step of forming a multilayered coil by inserting insulating paper 13, which is provided with either pressure sensitive adhesive 18*a* or adhesive 18 disposed on both sides thereof, into at least one place between coil layers, and a final step for mounting magnetic core 15 to the multilayered coil from above and below. Since insulating paper 13 having either pressure sensitive adhesive 18*a* or adhesive 18 disposed on both surfaces thereof is used in the second step, occurrence of displacement between the laminated coil and insulating paper 13 can be prevented at the time they are put into and out of a tooling jig and at the final step. Thus, a thin multilayered-coil transformer of a coil-base-less type providing stabilized insulating performance and electrical performance and enhanced productivity, as well as a method of manufacturing the same, can be provided.

Since PI having a high melting point (400° C. or above) is used as the insulating paper, a very high level of safety against the heat produced in the coil can be obtained when it is used for inter-coil insulation. High heat resistant insulation withstanding continuous use under F class (155° C.) and above can be realized. Accordingly, the transformer size can still be reduced. Further, since a tape with pressure sensitive adhesive 18*a* attached thereto is used as insulating paper 13, a step of applying an adhesive and a step for curing it can be omitted in the step of piling up coils and insulating papers 13 and bonding them together.

Further, since at least one of primary coil 11 and secondary coil 12 is a thin plate type coil, magnetic efficiency between the primary and secondary coils is enhanced. Further, since coils formed from a thin sheet of copper plate are used, cross-sectional areas can be enlarged and hence large currents are allowed to flow therethrough. If, here, at least one of the primary coil and secondary coil is formed on a printed circuit board, the position of the coil conductor and the thickness of the laminated coil can be stabilized and hence variations in performances can be reduced.

In the second step for piling up the coils, a suitable jig is used for accurately positioning and piling up the coils and insulating papers.

Accordingly, relative positions between coils and insulating papers can be accurately aligned even if a coil base is not used.

Further, in the first step for preparing thin coils, if coils are formed from a copper plate by punching, productivity of coils can be improved and their unit price can be lowered. Further, if the coils are produced from a copper plate by etching, the need for metal dies for punching can be eliminated. It is suited for flexible manufacturing systems because investment can be decreased. Further, burrs are not produced at coil end faces. Although pressure sensitive adhesive 18*a* is applied to insulating paper 13 in the first embodiment of the invention, adhesive 18, in place of pressure sensitive adhesive 18*a*, may be applied at the laminating step. Further, instead of preparing insulating papers 13 formed into predetermined shapes, the paper material may be bonded to coils and then may be subjected to punching and, thereafter, they may be laminated.

Second Exemplary Embodiment

Figure 2:
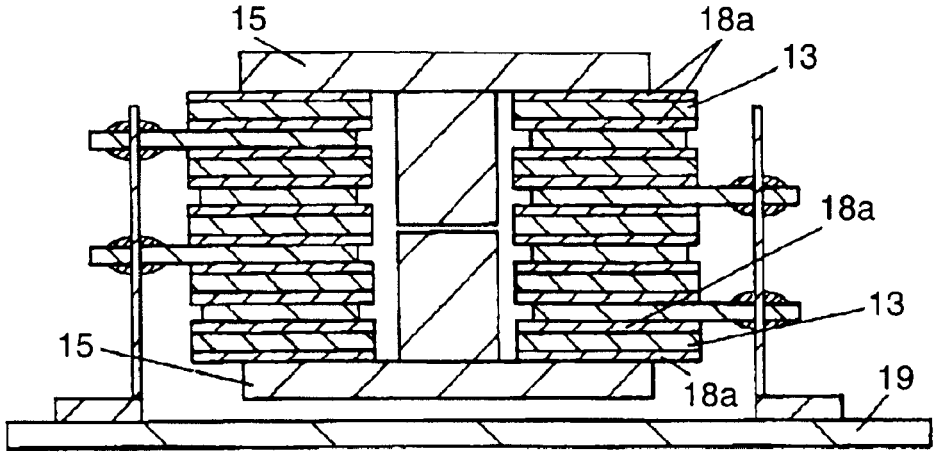
FIG. 2 is a sectional view showing a laminated structure of a thin transformer in a second exemplary embodiment of the invention.

FIG. 2 is a sectional view showing a laminated structure of a thin transformer of a second exemplary embodiment of the invention. The structure is basically the same as that in the first exemplary embodiment. It greatly differs therefrom in that pressure sensitive adhesive 18*a* is disposed on both sides of insulating paper 13 on the bottommost layer and topmost layer. By disposing pressure sensitive adhesive 18*a* on both sides of at least one of insulating papers 13 placed at the bottommost layer and topmost layer, the need for the step for bonding the coil and the core together can be eliminated.

Third Exemplary Embodiment

Figure 3:
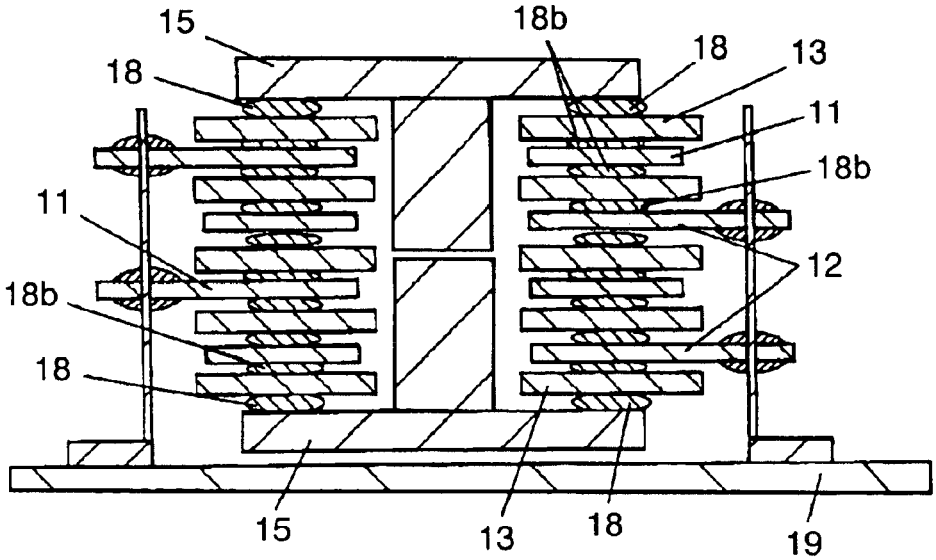
FIG. 3 is a sectional view showing a laminated structure of a thin transformer in a third exemplary embodiment of the invention.
Figure 4:
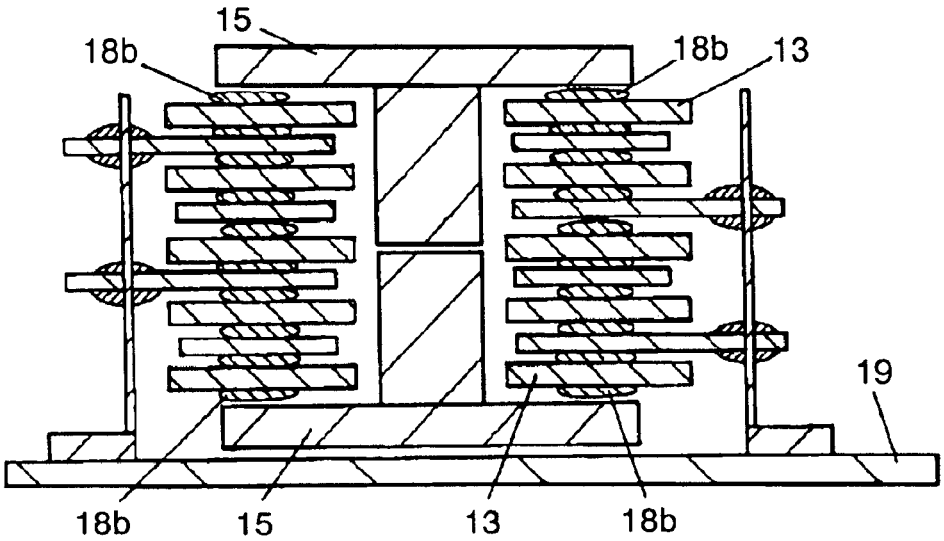
FIG. 4 is a sectional view showing an adhesive used in the third embodiment of the invention.

A third exemplary embodiment of the invention will be described with reference to FIG. 3 and FIG. 4. FIG. 3 is a sectional view showing a laminated structure of a thin transformer of a third exemplary embodiment of the invention. FIG. 4 is a sectional view showing an adhesive used in the third embodiment of the invention. Basic structure shown in FIG. 3 and FIG. 4 is the same as that shown in FIG. 1. It greatly differs from that in the point that adhesive 18*b* is applied not to the entire surface of insulating paper 13 but to part of the surface. In the manufacturing process, adhesive 18*b* is applied to part of insulating paper 13, not to the entire surface facing the coil. Material of adhesive 18*b* used on the bottommost layer and the topmost layer is the same as that of adhesive 18*b* used between coil layers. Since the same adhesive coating machine can be shared, investment can be decreased. Further, the amount of the adhesive used can be reduced. Since the need for applying adhesive 18*b* uniformly to all over the surface of insulating paper 13 can be eliminated, application work can be performed with a simple applicator. Further, in the laminating process, positional deviations between the coil and insulating paper 13 can be corrected with ease.

Fourth Exemplary Embodiment

Figure 5:
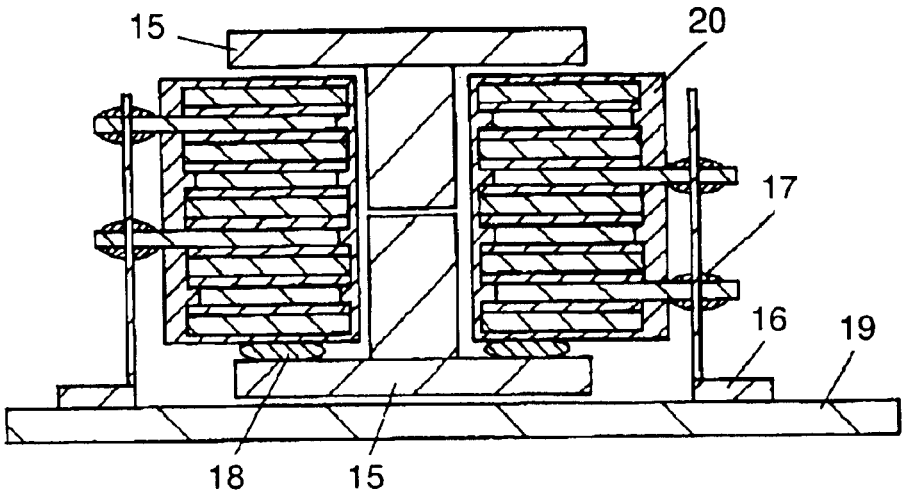
FIG. 5 is a sectional view showing a laminated structure of a thin transformer in a fourth exemplary embodiment of the invention.

FIG. 5 is a sectional view showing a laminated structure of a thin transformer of a fourth exemplary embodiment of the invention. Although the structure of FIG. 5 is basically the same as that of FIG. 1, it is greatly different therefrom in that the entire body of the laminated coil is sealed in insulating resin 20. Insulating resin 20 used in FIG. 5 is a thermoplastic liquid crystal polymer. Aromatic polyamide or polyimide resin can be used as the liquid crystal polymer. In the method of sealing up, the entire body of the multilayered coil is subjected to injection molding after laminated coils have been formed. Since the entire body of the multilayered coil is sealed up with insulating resin 20, the resin penetrates into spaces between laminated coils.

As a result, temperature equalization at the coil portion can be attained and, hence, temperature rise can be reduced. Further, since insulation between the coils and between the coil and magnetic core 15 can be strengthened, the insulating distance can be decreased and size reduction can be attained.

Since, the shape after the molding is stabilized, mounting of magnetic core 15 becomes easy. Further, moisture resistance and dust resistance of finished transformer products become improved. Since insulating resin 20 for the molding is thermoplastic resin, the resin can be recovered for reuse to thereby reduce the material cost. Further, since insulating resin 20 is a high-temperature resisting liquid-crystal polymer, it can stand reflow soldering at the time of surface mounting of the transformer. Further, it is also possible to realize high-temperature resisting insulation enduring continuous use under temperatures of class F (155° C.) and above.

On account of these facts, still smaller size of transformers can be realized.

Since the entire body of the multilayered coil can be subjected to injection molding, the molding time can be shortened and productivity enhanced. Further, since coils and insulating paper are bonded together, movement of coils by the fluid pressure of the resin during the molding process can be prevented.

Fifth Exemplary Embodiment

A fifth exemplary embodiment of the invention will be described with reference to FIG. 6 to FIG. 9. Its configuration is basically the same as that of the fourth exemplary embodiment. The points in which it greatly differs therefrom are that primary coil 11 is a wirewound coil and that connection portions 17 between primary coil 11*a*, as well as secondary coil 12, and terminal 16 are covered with resin molding 20. As shown in FIG. 7, primary coil 11*a* of a wirewound type, secondary coil 12 of a non-wirewound type, and insulating paper 13 with a pressure sensitive adhesive attached thereto are prepared. The wire material of primary coil 11*a* is a round wire coated with an insulating film having a solvent bonding type adhesive 6 layer on the outermost layer.

Primary coil 11*a* is manufactured by winding the wire material into the coil on a winding machine provided with a solvent applicator, with the use of a winding jig, while the bonding layer on the wire surface is dissolved by a solvent. At this time, alcohol is frequently used as the solvent. Examples of the alcohol are ethyl alcohol and isopropyl alcohol. Then, as shown in FIG. 7, primary coil 11*a* and secondary coil 12 are piled on one another with insulating paper 13, having a pressure sensitive adhesive attached thereto, inserted between the coils to thereby form a multilayered coil.

Figure 6:
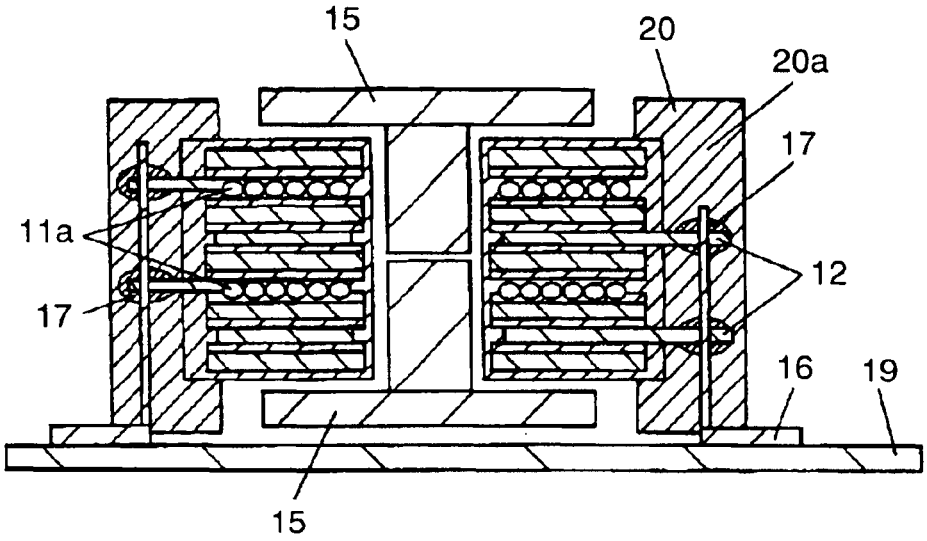
FIG. 6 is a sectional view showing a laminated structure of a thin transformer in a fifth exemplary embodiment of the invention.
Figure 7:
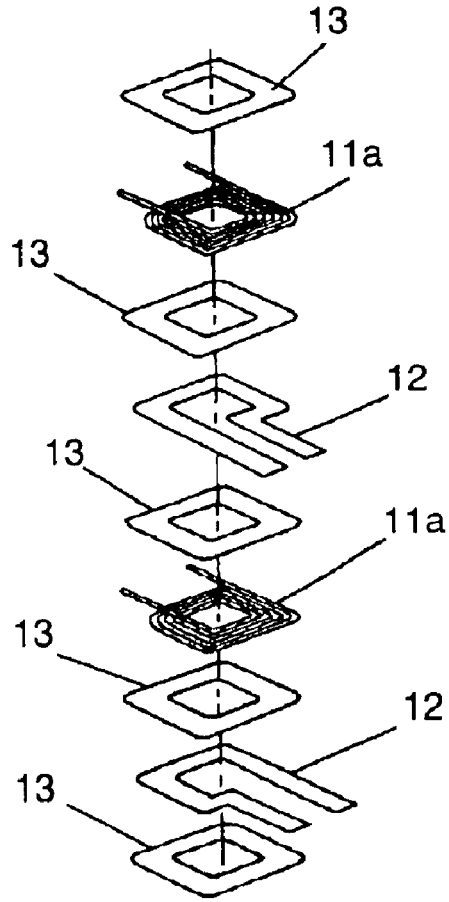
FIG. 7 is an exploded perspective view showing a laminated structure of coils in the fifth exemplary embodiment of the invention.
Figure 8:
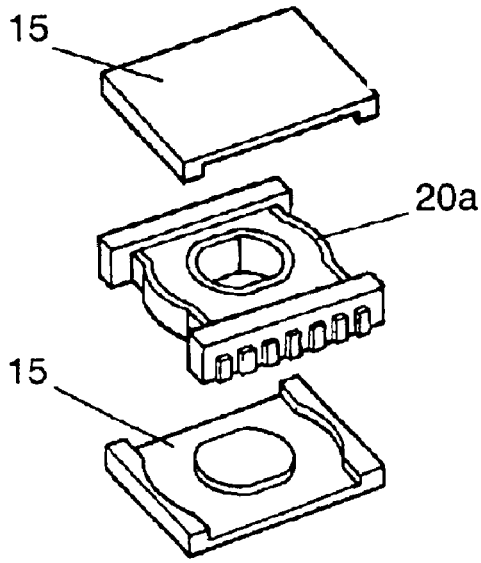
FIG. 8 is an exploded perspective view showing a thin transformer in the fifth exemplary embodiment of the invention.
Figure 9:
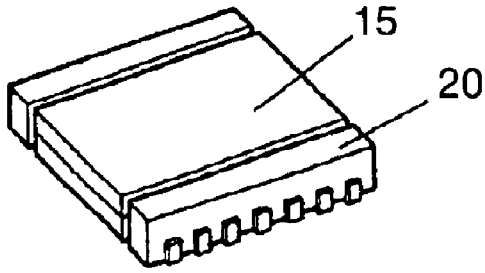
FIG. 9 is perspective view of the thin transformer in the fifth exemplary embodiment of the invention.
Figure 10:
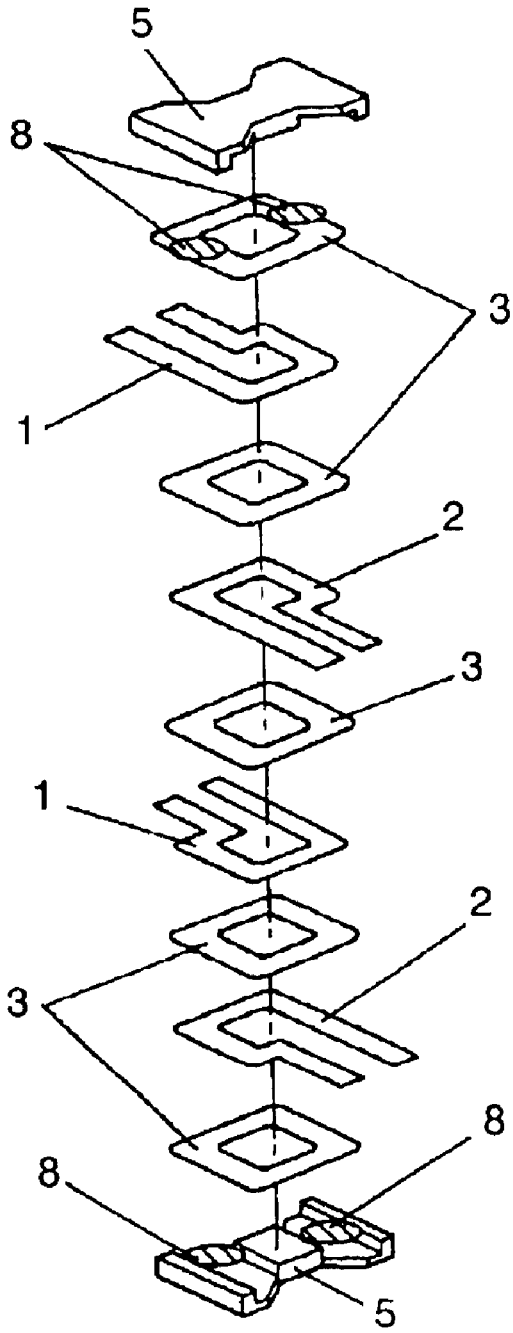
FIG. 10 is an exploded perspective view explanatory of a conventional thin transformer.
Figure 11:
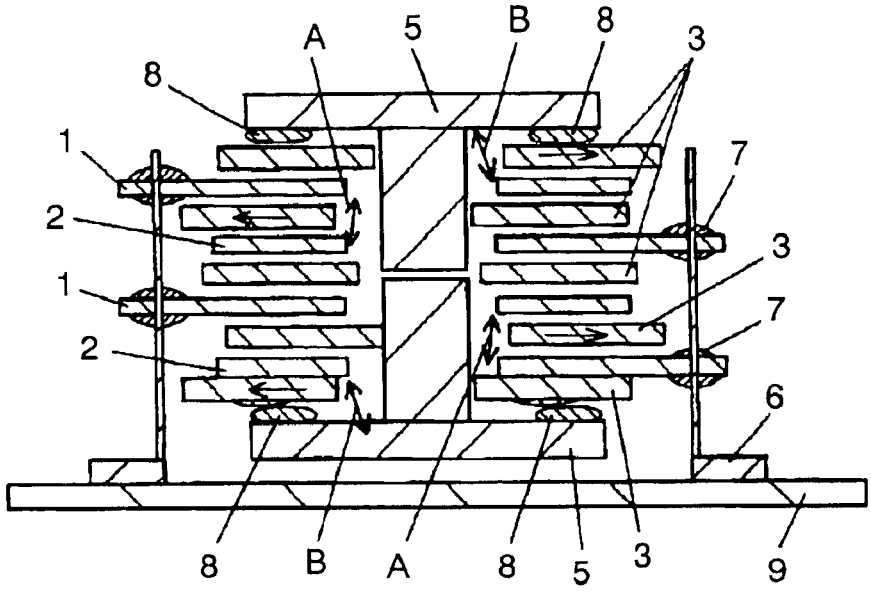
FIG. 11 is a sectional view showing a laminated structure of the conventional thin transformer.

Then, after terminals 16 and coils have been connected together, the entire body of the multilayered coil including terminal connection portions 17 is sealed up by molding with insulating resin 20 as shown in FIG. 6 to thereby form molded coil 20*a*. Thereafter, by mounting magnetic cores 15 to molded coil 20*a* from above and below as shown in FIG. 8, a thin transformer as shown in FIG. 9 is completed. Since at least one of the primary coil and secondary coil is a wirewound coil, requirement for a change in the number of turns can be readily met and hence a high degree of freedom in designing can be obtained.

Further, since a round electric wire is used as the electric wire, cost of wire material can be reduced. Further, wiring speed can be increased resulting in an improvement in workability. Further, since the coil is covered with an insulating film, insulation between adjoining windings can be secured and insulation between coils vertically adjoining each other and insulation between the coil and the magnetic core can also be strengthened.

Further, since the surface of the winding is covered with a solvent bonding layer, the bonding can be performed only by applying a solvent to the winding just wound. Thus, formation of the winding can be performed by means of a simple setup without using a bobbin. Further, since connection portions 17 between the coil and the terminal are formed within resin molding 20, insulation between connection portion 17 and the coil can be strengthened.

Since dirt is prevented from entering from outside into connection portion 17, high degree of safety and reliability can be realized. In the method of manufacturing the above described fifth exemplary embodiment, coils are formed by winding a wire in the first step of preparing thin coils. Since such processes as etching and punching are not required, a need to change the number of turns can be readily met. The first step of preparing a thin coil by winding a wire includes the step of dissolving the adhesive layer on the wire surface with a solvent. Wire winding and bonding can be performed simultaneously only by having the winding machine equipped with a solvent applicator.

As compared with such a method as a hot melt adhesion method, a step of thermosetting can be eliminated so that the process of manufacture is simplified. Further, since the electric wire used in the fifth exemplary embodiment is a flat-rectangular wire, the space factor of the winding can be increased. Reduction in resistance of the winding and hence reduction in loss can be realized. Further, if the electric wire used in the fifth exemplary embodiment is provided by an electric wire with a three-layer insulating coating, sufficient insulation to a high voltage input can be ensured. It is also easy to comply with safety standards and other specifications. The multilayered coil in the present invention means a coil in which at least one of the primary coil and secondary coil is formed of a thin coil and such thin coils are piled on one another to provide the multilayered coil.

Industrial Applicability

The present invention provides a multilayered-coil thin transformer of a coil-base-less type stabilized in insulating performance and electrical performance and capable of improving productivity and, also, provides a method of manufacturing the same.

What is claimed is:

1. A thin transformer comprising:

an insulating paper having one of a pressure sensitive adhesive and an adhesive disposed on both faces thereof;

a multilayered coil configured by having said insulating paper inserted into at least one place between thin coil layers; and magnetic cores mounted to said multilayered coil from above and below.

2. The thin transformer according to claim 1, wherein said insulating paper is a polyimide film.

3. The thin transformer according to claim 1, wherein said insulating paper having a pressure sensitive adhesive is a tape having a pressure sensitive adhesive attached thereto.

4. The thin transformer according to claim 3, wherein at least one of said insulating papers provided on a bottommost layer and a topmost layer has the pressure sensitive adhesive disposed on both faces thereof.

5. The thin transformer according to claim 1, wherein said insulating paper has the adhesive disposed at a portion of the face of said insulating paper.

6. The thin transformer according to claim 5, wherein one of the adhesive and the pressure sensitive adhesive disposed on said insulating paper provided on at least one of a bottommost layer and a topmost layer is identical to one of the adhesive and the pressure sensitive adhesive disposed on said insulating paper used between coils.

7. The thin transformer according to claim 1, wherein an entire body of said multilayered coil is sealed in an insulating resin.

8. The thin transformer according to claim 7, wherein the insulating resin is a thermoplastic resin.

9. The thin transformer according to claim 8, wherein the thermoplastic resin is a liquid crystal polymer.

10. The thin transformer according to claim 1, wherein at least one of a primary coil and a secondary coil is a coil in a thin plate form.

11. The thin transformer according to claim 10, wherein the coil in a thin plate form is a copper plate.

12. The thin transformer according to claim 1, wherein at least one of a primary coil and a secondary coil is a coil formed on a printed circuit board.

13. The thin transformer according to claim 1, wherein at least one of a primary coil and a secondary coil is a coil formed by winding an electric wire.

14. The thin transformer according to claim 13, wherein the electric wire is one of a round electric wire, a flat-rectangular electric wire, and an electric wire provided with a three-layer insulating coating.

15. The thin transformer according to claim 14, wherein the electric wire has a solvent bonding layer.

16. The thin transformer according to claim 15, wherein the solvent bonding layer is of an alcohol bonding type.

17. The thin transformer according to any of claims 7 to 13, wherein a connection portion between said multilayered coil and a terminal is sealed in a resin molding.

18. A method of manufacturing a thin transformer comprising:

a first step for preparing thin coils constituting primary coils and secondary coils;

a second step for forming a multilayered coil by inserting an insulating paper having one of a pressure sensitive adhesive and an adhesive disposed on both faces thereof into at least one place between the thin coils; and a final step for mounting magnetic cores to the multilayered coil from above and below.

19. The method of manufacturing a thin transformer according to claim 18, wherein, in said second step, the adhesive is applied to a portion of an interface between the insulating paper and the multilayered coil.

20. The method of manufacturing a thin transformer according to one of claim 18 and claim 19, further comprising a step, between said second step and said final step, of sealing up an entire body of the multilayered coil by injection molding.

21. The method of manufacturing a thin transformer according to any of claims 18 and 19, wherein, in said first step, a coil is formed from a copper plate by punching.

22. The method of manufacturing a thin transformer according to any of claims 18 and 19, wherein, in said first step, a coil is formed from a copper plate by etching.

23. The method of manufacturing a thin transformer according to any of claims 18 and 19, wherein, in said first step, a coil is formed by winding an electric wire.

24. The method of manufacturing a thin transformer according to claim 23, wherein said first step includes a step of dissolving a solvent bonding layer on a surface of the electric wire with a solvent.

25. The method of manufacturing a thin transformer according to claim 24, wherein the solvent is alcohol.

* * * * *